US005768851A

United States Patent [19]

Nagaoka

[11] Patent Number: 5,768,851

[45] Date of Patent: Jun. 23, 1998

[54] STRUCTURE UNIT

[76] Inventor: Tadayoshi Nagaoka, 573-2, Oaza Ureshi, Tondabayashi-shi, Osaka-fu, Japan

[21] Appl. No.: 827,327

[22] Filed: Mar. 26, 1997

[51] Int. Cl.[6] ..... E04B 2/28; E04B 5/00; E04C 2/34

[52] U.S. Cl. ..... 52/790.1; 52/309.11; 52/426; 52/783.1; 52/590.2

[58] Field of Search ..... 52/790.1, 783.1, 52/424, 425, 426, 428, 431, 432, 590.1, 590.2, 379, 574, 309.11, 309.12, 309.14, 309.16, 309.17, 284

[56] References Cited

U.S. PATENT DOCUMENTS

| | | | |
|---|---|---|---|
| 3,191,724 | 6/1965 | De Ridder | 52/790.1 X |
| 5,294,472 | 3/1994 | Arnold et al. | 52/790.1 X |
| 5,553,430 | 9/1996 | Majnaric et al. | 52/426 X |

FOREIGN PATENT DOCUMENTS

| | | | |
|---|---|---|---|
| 565212 | 1/1960 | Belgium . | |
| 0026605 | 4/1981 | European Pat. Off. . | |
| 0054856 | 6/1982 | European Pat. Off. . | |
| 0138393 | 4/1985 | European Pat. Off. . | |
| 544758 | 9/1922 | France . | |
| 1187010 | 9/1959 | France | 52/790.1 |
| 7210838 | 6/1972 | Germany . | |
| 9418602 | 1/1995 | Germany . | |
| 385458 | 3/1965 | Switzerland . | |
| 1098681 | 1/1966 | United Kingdom . | |
| 2028233 | 3/1980 | United Kingdom . | |

*Primary Examiner*—Robert Canfield
*Attorney, Agent, or Firm*—Hedman, Gibson & Costigan, P.C.

[57] ABSTRACT

A structure unit includes a pair of outer panels disposed in parallel to each other with a predetermined distance therebetween, a plurality of partition panels provided between the pair of outer panels in a direction crossing the outer panels with a predetermined distance between the respective partition panels and with at least one end portion of the partition panels being connected to an inner surface of one of the outer panels, a unit space of a rectangular cross section being defined by adjacent ones of the partition panels and the inner surfaces of the outer panels. The structure unit further includes two pairs of inner diagonal panels provided substantially along diagonals of the rectangular cross section of the unit space, each of the pairs of inner diagonal panels consisting of panels located on the same diagonal and each of the panels having one end portion connected to the inner surface of one of the outer panels and an opposite end portion separated from an opposite end portion of the other panel of the same pair by a predetermined distance in a central portion of the unit space.

4 Claims, 4 Drawing Sheets

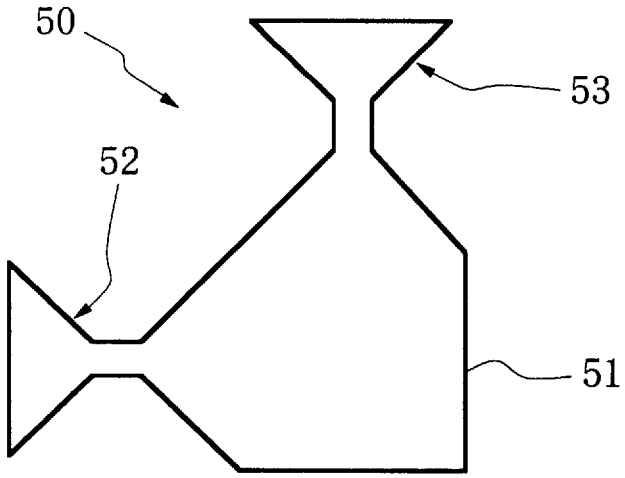
FIG. 9
FIG. 10
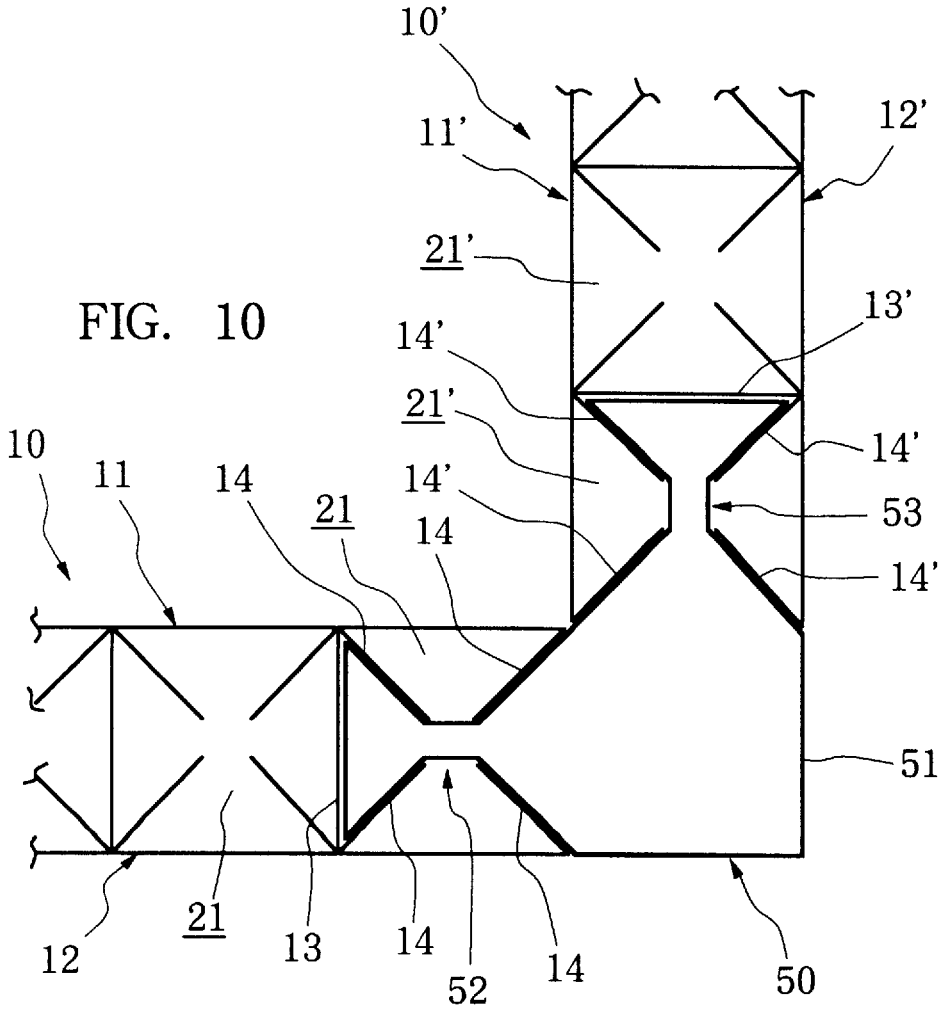

STRUCTURE UNIT

BACKGROUND OF THE INVENTION

This invention relates to a structure unit suitable for use as a building material such as a wall material and a floor material as well as for use as a unit for constructing a container and a conveying device such as a pallet.

It is an object of the invention to provide a structure unit for various applications including building materials such as a wall material, floor material, a frame and a partition as well as a container and a conveying device such as a pallet which is light in weight and high in strength and easy to assemble.

SUMMARY OF THE INVENTION

For achieving the above described object of the invention, there is provided a structure unit comprising a pair of outer panels disposed in parallel to each other with a predetermined distance therebetween, a plurality of partition panels provided between the pair of outer panels in a direction crossing the outer panels with a predetermined distance between the respective partition panels and with at least one end portion of the partition panels being connected to an inner surface of one of the outer panels, a unit space of a rectangular cross section being defined by adjacent ones the partition panels and the inner surfaces of the outer panels, and two pairs of inner diagonal panels provided substantially along diagonals of the rectangular cross section of the unit space, each of said pairs of inner diagonal panels consisting of panels located on the same diagonal and each of said panels having one end portion connected to the inner surface of one of the outer panels and an opposite end portion separated from an opposite end portion of the other panel of the same pair by a predetermined distance in a central portion of the unit space.

According to the invention, there is provided a structure unit which is light in weight and high in strength. The structure unit can be assembled easily by utilizing the inner diagonal panels provided in the unit space. The inner diagonal panels serve not only for facilitating assembly of the structure unit but also for absorbing sound by absorbing vibration energy because the inner diagonal panels reflect and diffuse vibration and sound. The inner diagonal panels also serve as reinforcing members and thereby increase an earthquake-proof property of the structure unit. Owing to these properties, the structure unit is suitable for various applications including building materials such as wall and floor materials, frames and partitions as well as containers and a conveying device such as a pallet.

In one aspect of the invention, a filling material is filled in the unit space. By filling a filling material in the unit space, the sound absorbing property and strength of the structure unit are enhanced.

In another aspect of the invention, the structure unit further comprises a connecting member for connecting said outer panels together comprising a first pair of panels which, in said unit space, can fittingly engage the two inner diagonal panels which are fixedly secured to one of the outer panels on the surfaces of the inner diagonal panels facing said one of the outer panels, a second pair of panels which, in said unit space, can fittingly engage the two inner diagonal panels which are fixedly secured to the other of the outer panels on the surfaces of the inner diagonal panels facing said the other of the outer panels, and a connecting element connecting said first pair of panels with said second pair of panels.

According to this aspect of the invention, the pair of outer panels are connected to each other by the connecting member and, therefore, the structure unit can be assembled even more easily.

In still another aspect of the invention, the structure unit further comprises a connecting member for connecting said structure unit with an adjacent structure unit, said connecting member comprising at least two engaging portions each of which can fittingly engage the unit space of said structure unit.

According to this aspect of the invention, adjacent structure units can be assembled easily by means of the connecting member which can fittingly engage the unit spaces of the adjacent structure units.

These and other objects and features of the invention will become apparent from the description made hereinbelow in conjunction with the accompanying drawings.

BRIEF DESCRIPTION OF THE DRAWINGS

In the accompanying drawings,

FIG. 9 is a sectional view of an example of the connecting member for connecting adjacent structure units with an angle; and FIG. 10 is a sectional view showing the manner of connection of the adjacent structure units with an angle by using the connecting member shown in FIG. 9.

DESCRIPTION OF PREFERRED EMBODIMENT

An embodiment of the structure unit made according to the invention will now be described with reference to the accompanying drawings.

Figure 1:
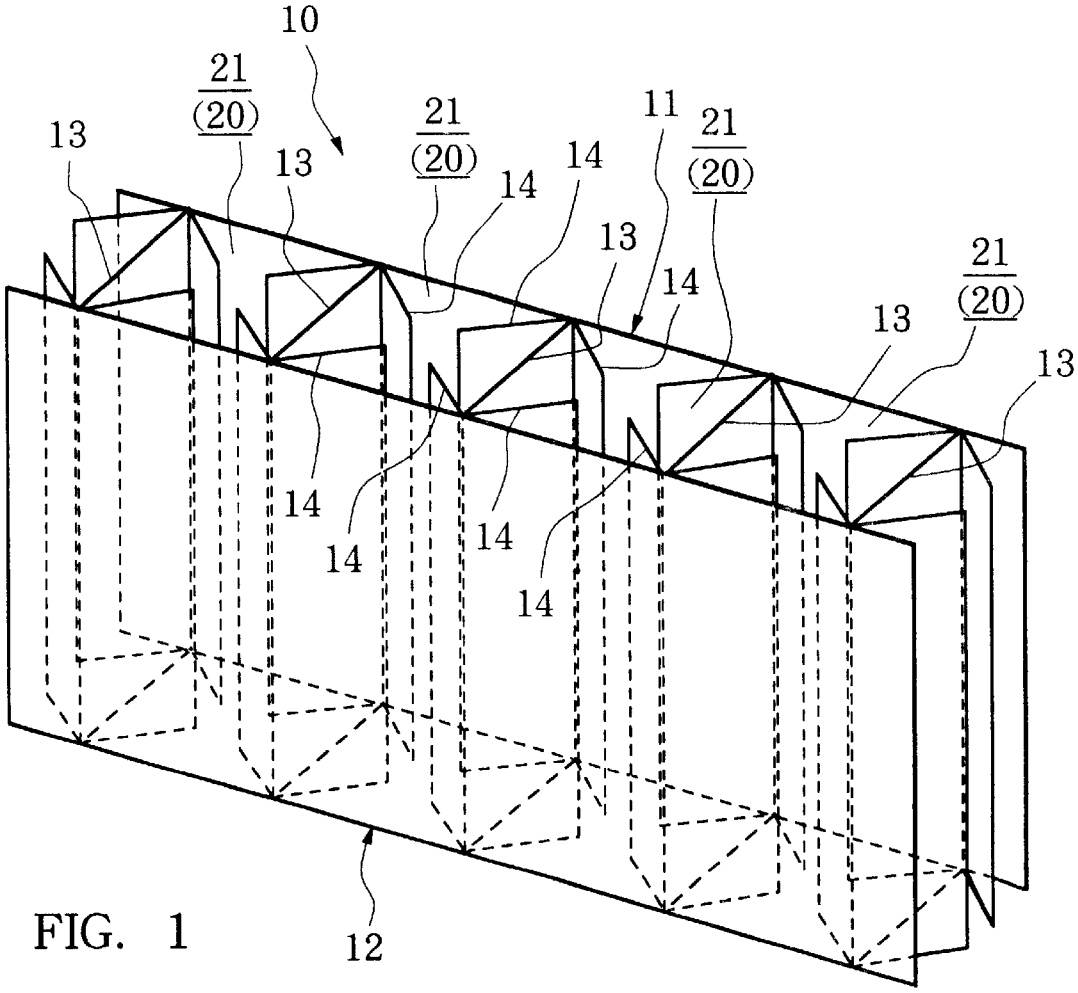
FIG. 1 is a partial perspective view of a preferred embodiment of the structure unit made according to the invention.
Figure 2:
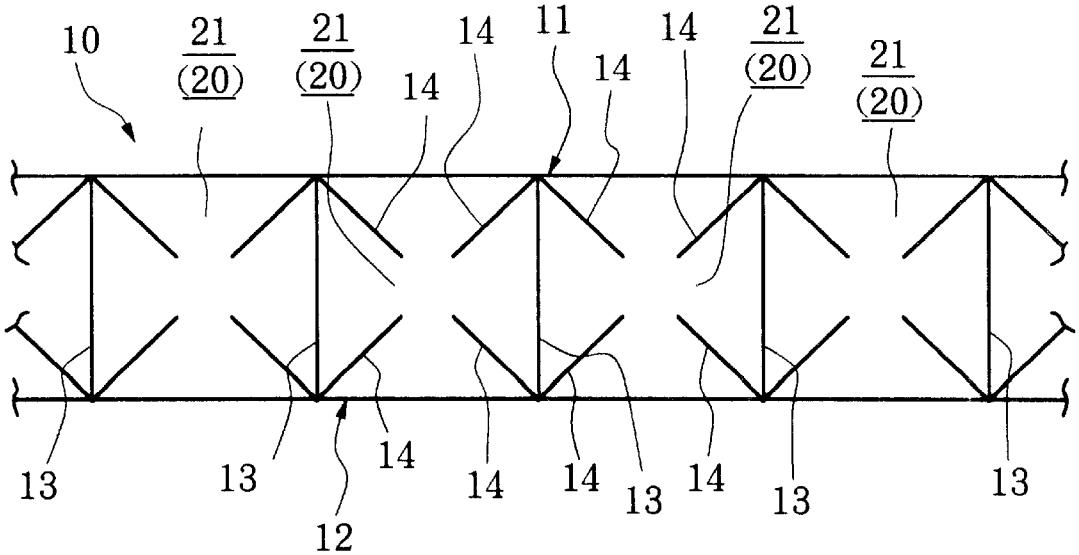
FIG. 2 is a sectional view of the embodiment.

Referring to FIGS. 1 and 2, a structure unit 10 includes a pair of outer panels 11 and 12 which are disposed in parallel to each other with a predetermined distance therebetween. A plurality of partition panels 13 are provided between the pair of outer panels 11 and 12 in a direction crossing the outer panels 11 and 12. The partition panels 13 are fixedly connected at both ends thereof to the inner surfaces of the outer panels 11 and 12. Space 20 formed between the outer panels 11 and 12 are partitioned by the partition panels 13 into unit spaces 21 of a rectangular cross section. That is, each unit space 21 is defined by adjacent ones of the partition panels 13 and the inner surfaces of the outer panels 11 and 12. The unit space 21 may be either square or oblong in cross section.

Two pairs of inner diagonal panels 14 are provided substantially along diagonals of the rectangular cross section of each unit space 21. Each pair of the inner diagonal panels 14 are located on the same diagonal and each of the inner diagonal panels 14 has one end portion fixedly connected to the inner surface of one of the outer panels 11 and 12 and an opposite end portion separated from an opposite end portion of the other inner diagonal panel 14 of the same pair by a predetermined distance in a central portion of the unit space 21. In other words, each pair of the inner diagonal panels 14 on the same diagonal are discontinuous in their opposite ends in the central portion of the unit space 21.

A material for forming the structure unit 10 may be selected from among various materials including metals such as iron, steel and aluminum as well as plastics.

In the structure unit 10, the unit spaces 21 and the inner diagonal panels 14 provided in the unit spaces 21 serve for reflecting and diffusing vibration and sound and thereby producing a sound absorption effect. The inner diagonal panels 14 serve also as reinforcing members and thereby increase an earthquake-proof property of the structure unit 10.

The space 20 between the outer panels 11 and 12 (i.e., the unit spaces 21) are useful for filling a filing material therein. If a heat insulating material is filled as a filling material in the unit spaces 21, the structure unit 10 will be imparted with a heat insulation property. If concrete is filled as a filling material, the inner diagonal panels 14 serve as a reinforcing member for concrete and thereby increases strength of the structure unit 10. If a foamed resin such as foamed polystyrene is mixed with concrete to be filled, a structure unit of a light weight and a high strength can be formed. In this case, the weight of the structure unit can be adjusted by varying the amount of a foamed resin to be mixed with concrete.

Since the inner diagonal panels 14 of each pair are separated, i.e., discontinuous, in the central portion of the unit space 21, a filling material may be filled at any location in the unit space 21. A filling material filled at any location in the unit space 21 will flow through the open central portion of the unit space 21 to every corner of the unit space 21 and thereby fill the entire unit space 21. This will enable the filling work to be achieved easily and efficiently as compared with a case where the inner diagonal plates 14 of each pair are continuous and thereby leave no open central space in the unit space 21.

For manufacturing the structure unit 10 of the above construction, an integral structure unit may be formed by an extruder die having a corresponding configuration. Alternatively, the structure unit 10 may be formed by assembling two parts of the structure unit 10 as shown in FIGS. 3 and 4.

Figure 3:
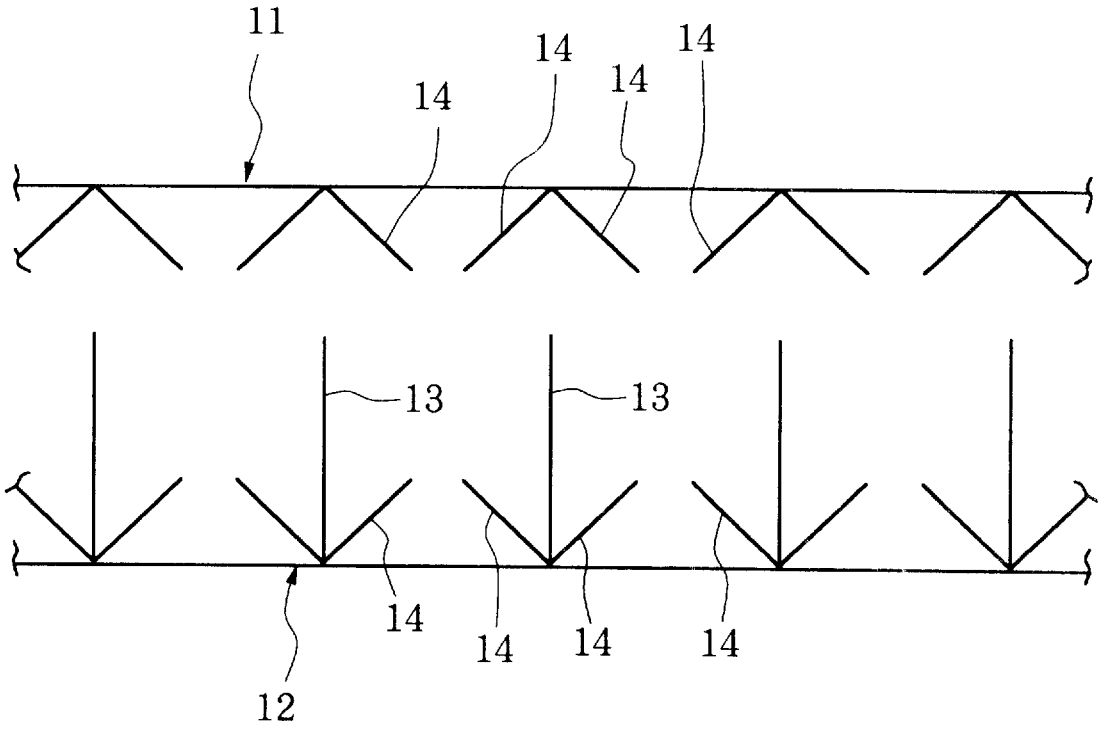
FIG. 3 is an exploded view showing an example of a manner of constructing the structure unit of the embodiment.

In the example shown in FIG. 3, the partition panels 13 and the inner diagonal panels 14 are integrally connected to the inner surface of the outer panel 12 in such a manner that each of the partition panels 13 extend normally with respect to the inner surface of the outer panel 12 and two inner diagonal panels 14 extend from the connecting point of the partition panel 13 to the outer panel 12 at an angle of 45 degrees with respect to the inner surface of the outer panel 12. Two inner diagonal panels 14 are connected integrally to the inner surface of the outer panel 11 in such a manner that the two inner diagonal panels 14 extend from a common connecting point to the outer panel 11 at an angle of 45 degrees with respect to the inner surface of the outer panel 11. By fixedly securing the end portion of the partition panel 13 to the connecting point of the inner diagonal panels 14 connected to the outer panel 11, the structure unit 10 can be assembled.

Figure 4:
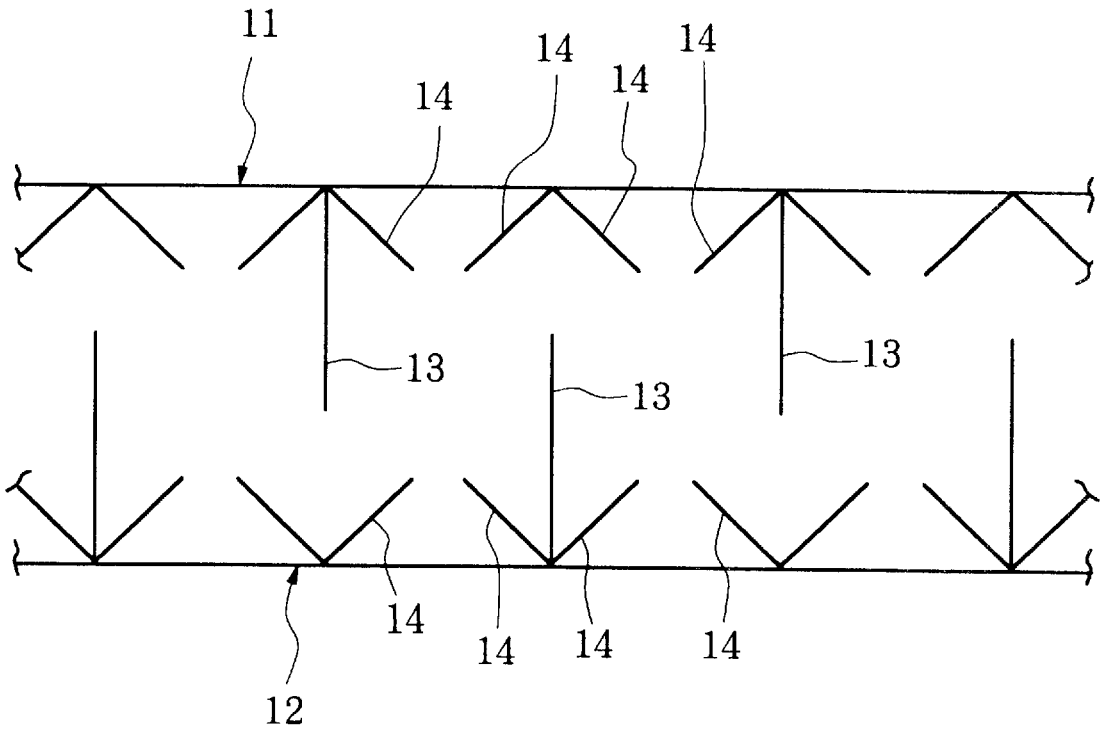
FIG. 4 is an exploded view showing another example of a manner of constructing the structure unit of the embodiment.

In FIG. 4, another example of parts of the structure unit 10 are shown. In this example, the inner diagonal panels 14 are connected to the inner surfaces of the outer panels 11 and 12 in the same manner as in the example of FIG. 3 and the partition panels 13 are connected to every other common connecting point of the inner diagonal panels 14 on the outer panels 11 and 12. By arranging the outer panels 11 and 12 so that the partition panels 13 abut against the common connecting points of the inner diagonal panels 14 where the partition panels 13 are not connected on the opposite outer panel 11 or 12 and fixedly securing the end portion of the partition panels 13 to the common connecting points of the opposite outer panel 11 or 12, the structure unit 10 can be assembled.

For fixedly securing the partition panels 13 to the inner surface of the outer panel 11 or 12, welding technique such as spot welding and laser welding may be utilized in a case where the structure unit 10 is formed of a metal and, in a case where the structure unit 10 is formed of plastics, heat welding or ultrasonic welding or bonding by an adhesive may be suitably employed.

Figure 5:
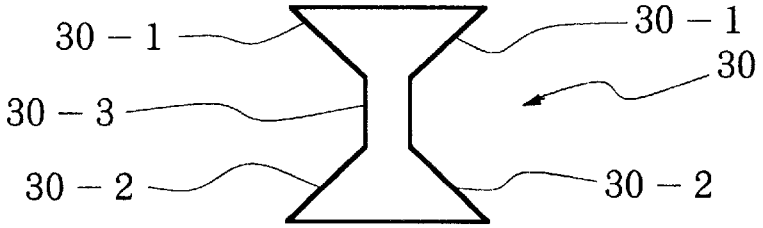
FIG. 5 is a sectional view of an example of the connecting member for connecting the outer panels together.
Figure 6:
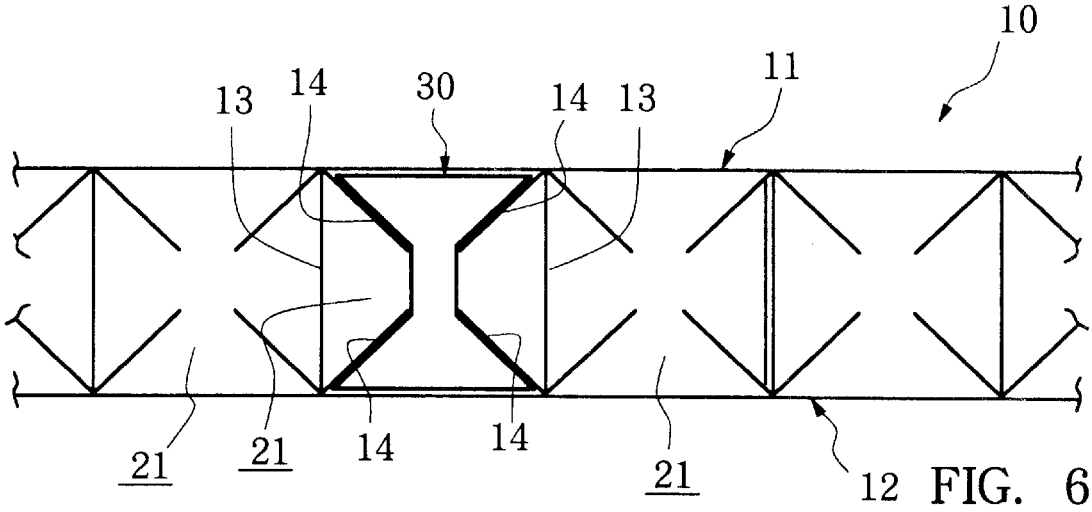
FIG. 6 is a sectional view showing the manner of connection of the outer panels by using the connecting member shown in FIG. 5.

Connection of the outer panels 11 and 12 may be achieved by using a connecting member. FIGS. 5 and 6 show an example of such connection of the outer panels 11 and 12 by using a connecting member 30. The connecting member 30 has a first pair of panels 30-1 which, in the unit space 21, can fittingly engage the two inner diagonal panels 14 which are connected to one of the outer panels 11 (or 12) on the surfaces of the inner diagonal panels 14 facing the outer panel 11 (or 12), a second pair of panels 30-2 which, in the unit space 21, can fittingly engage the two inner diagonal panels 14 which are connected to the other outer panel 12 (or 11) on the surfaces of the inner diagonal panels 14 facing the other outer panel 12 (or 11), and a connecting element 30-3 connecting the first pair of panels 30-1 with the second pair of panels 30-2. By arranging the two parts of the structure unit 10 shown in FIG. 3 or 4 in the completed configuration of the structure unit 10 and inserting the connecting member 30 in one of the unit sections 21 in such a manner that the panels 30-1 and 30-2 fittingly engage the corresponding surfaces of the inner diagonal panels 14, the outer panels 11 and 12 are inseparably connected to each other and the structure unit 10 thereby can be assembled. Use of the connecting member greatly facilitates connection of the outer panels 11 and 12 together.

The structure unit 10 can be formed in a desired size and a wall or other three-dimensional structure can be constructed by assembling a necessary number of the structure unit 10.

Connection of adjacent structure units 10 will now be described. Component parts of an adjacent structure unit which will be connected to the structure unit 10 are designated by reference characters with a dash. For connecting the structure unit 10 with the adjacent structure unit 10', a connecting member 40 is used. The connecting member 40 has two engaging portions 41 and 42 which can engage the adjacent unit sections 21 and 21' of the structure units 10 and 10'. More specifically, the engaging portion 41 of the connecting member 40 has a first pair of panels 41-1 which engage the inner diagonal panels 14 connected to the outer panel 11 (or 12) and a second pair of panels 41-2 which engage the inner diagonal panels 14 connected to the outer panel 12 (or 11). Likewise, the engaging portion 42 has a first pair of panels 42-1 which engage the inner diagonal panels 14 connected to the outer panel 11 (or 12) and a second pair of panels 42-2 which engage the inner diagonal panels 14 connected to the outer panel 12 (or 11). By inserting the connecting member 40 in the adjacent unit spaces 21 and 21' of the structure units 10 and 10', the structure units 10 and 10' can be connected together laterally, i.e., in the direction of width of the structure unit 10 (i.e., the direction normal to the partition panels 13).

Figure 7:
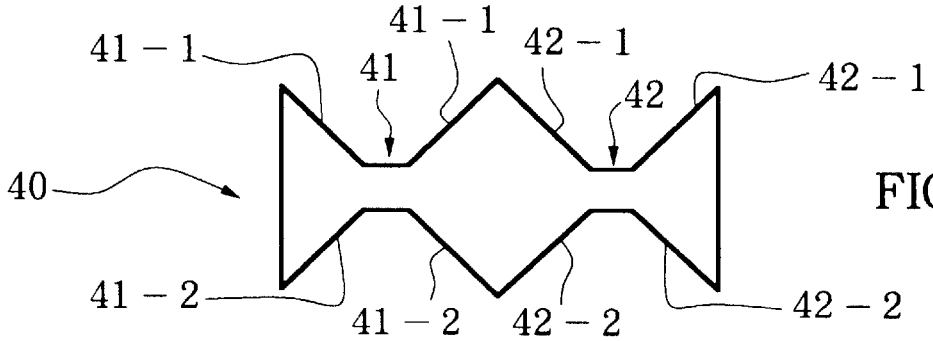
FIG. 7 is a sectional view showing an example of a connecting member for connecting adjacent structure units together.
Figure 8:
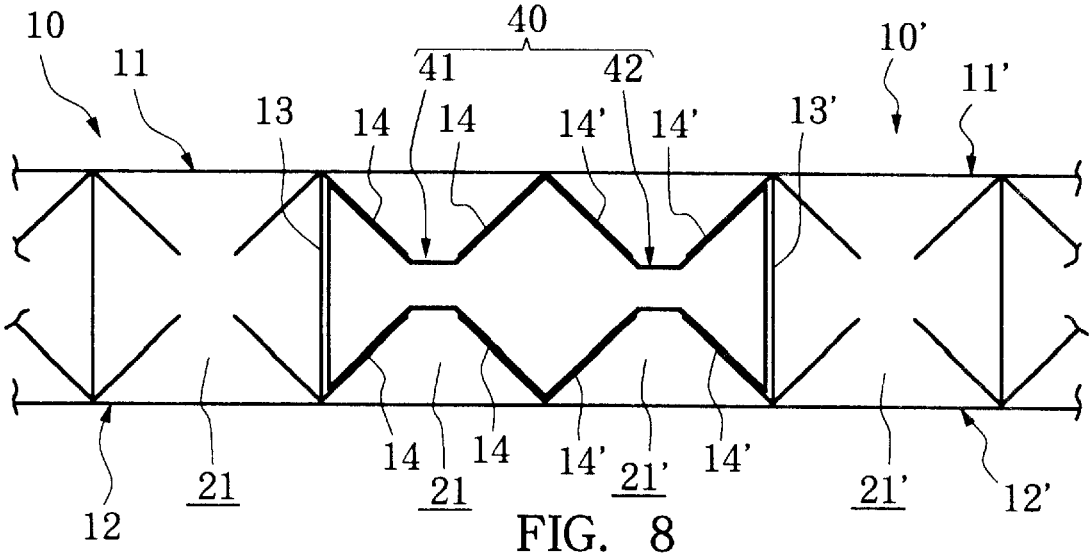
FIG. 8 is a sectional view showing the manner of connection of the adjacent structure units by using the connecting member shown in FIG. 7.

For connecting adjacent structure units 10 and 10' arranged at an angle as shown in FIG. 10, a connecting member as shown in FIG. 9 may be used. This connecting member 50 has a corner portion 51 and two engaging portions 52 and 53 which are of a shape similar to the two engaging portions 41 and 42 of the connecting member 40 of FIG. 7 but are arranged at a right angle to each other. By inserting the two engaging portions 52 and 53 of the connecting member 50 in adjacent unit spaces 21 and 21' of the structure units 10 and 10', the structure units 10 and 10' can be connected to each other at a right angle. The structure units 10 and 10' can be connected to each other at a desired angle by using a connecting member which has engaging portions arranged at such desired angle.

For connecting the structure units 10 vertically, such connection can be achieved by using a connecting member which has a length exceeding the length of the structure unit 10.

The structure unit 10 can be used for various purposes such as building materials including wall and floor materials, frames and partitions as well as containers and conveying devices such as pallets. In a case where the structure unit 10 is used as a building material, electric wires and water and gas pipes can be provided in the unit space 21. If a box calvert is constructed by using the structure unit 10 filled with weight-adjusted concrete, sinking of the box calvert in the ground due to self-weight can be effectively prevented. If a cason for building a breakwater is constructed with the structure unit 10 filled with weight-adjusted concrete, the cason can be towed in a floating state to the construction site so that building of the breakwater can be facilitated.

What is claimed is:

1. A structure unit comprising:

a pair of outer panels disposed in parallel to each other with a predetermined distance therebetween;

a plurality of partition panels provided between the pair of outer panels in a direction crossing the outer panels with a predetermined distance between the respective partition panels and with at least one end portion of the partition panels being connected to an inner surface of one of the outer panels, a unit space of a rectangular cross section being defined by adjacnet ones of the partition panels and the inner surfaces of the outer panels; and two pairs of inner diagonal panels provided substantially along diagonals of the rectangular cross section of the unit space, each of said pairs of inner diagonal panels consisting of panels located on the same diagonal and each of said panels having one end portion connected to the inner surface of one of the outer panels and an opposite end portion separated from an opposite end portion of the other panel of the same pair by a predetermined distance in a central portion of the unit space.

2. A structure unit as defined in claim 1 wherein a filling material is filled in the unit space.

3. A structure unit as defined in claim 1 which further comprises a connecting member for connecting said outer panels together comprising a first pair of panels which, in said unit space, can fittingly engage the two inner diagonal panels which are fixedly secured to one of the outer panels on the surfaces of the inner diagonal panels facing said one of the outer panels, a second pair of panels which, in said unit space, can fittingly engage the two inner diagonal panels which are fixedly secured to the other of the outer panels on the surfaces of the inner diagonal panels facing said the other of the outer panels, and a connecting element connecting said first pair of panels with said second pair of panels.

4. A structure unit as defined in claim 1 further comprising a connecting member for connecting said structure unit with an adjacent structure unit, said connecting member comprising at least two engaging portions each of which can fittingly engage the unit space of said structure unit.

* * * * *